United States Patent [19]

Duke et al.

[11] Patent Number: 4,558,859

[45] Date of Patent: Dec. 17, 1985

[54] STACK TOP CONTROL METHOD AND APPARATUS

[75] Inventors: B. Michael Duke, Plattsburgh; Edward L. Kempisty, Rouses Point, both of N.Y.

[73] Assignee: Harris Graphics Corporation, Melbourne, Fla.

[21] Appl. No.: 590,027

[22] Filed: Mar. 15, 1984

[51] Int. Cl.[4] ..... B65H 31/10

[52] U.S. Cl. ..... 271/200; 271/148; 271/215; 414/30; 414/907

[58] Field of Search ..... 271/148, 200, 152, 153, 271/154, 155, 156, 214, 215, 177, 178, 179, 180, 216, 181, 217, 199, 218, 227, 226; 414/29, 30, 36, 100, 907; 100/48; 53/540; 198/415, 395

[56] References Cited

U.S. PATENT DOCUMENTS

| | | | |
|---|---|---|---|
| 2,931,520 | 4/1960 | Shields | 414/36 |
| 3,503,606 | 3/1970 | Castellanet | 271/166 |
| 3,603,446 | 9/1971 | Maxey et al. | 271/227 |
| 3,617,055 | 11/1971 | Stal | 271/218 |
| 4,197,045 | 4/1980 | Stauber | 414/30 |
| 4,296,684 | 10/1981 | Wangerman | 414/907 |

*Primary Examiner*—George E. A. Halvosa
*Assistant Examiner*—James E. Barlow
*Attorney, Agent, or Firm*—Yount & Tarolli

[57] ABSTRACT

A stack top control method and apparatus includes sensing the vertical position of a top of signatures being stacked on a stacking platform at two spaced apart locations. Two belt assemblies tangentially contact at least a portion of opposed sides of the stack being formed adjacent the top locations being sensed. Each belt assembly is driven by a variable drive motor and applies a tangential, frictional drive force to the opposed sides of the stack being formed toward the stacking platform. A control circuit monitors the vertical position of the two spaced apart locations and controls the speed of each drive motor of the belt assemblies responsive to the sensed vertical position of the top of the signatures being formed into the stack. The top of the stack is thereby substantially leveled.

10 Claims, 5 Drawing Figures

STACK TOP CONTROL METHOD AND APPARATUS

TECHNICAL FIELD

The present invention relates to a method and apparatus for controlling sheet materials being stacked at a stacking workstation and more particularly to a method and apparatus for maintaining the top of a stack of sheet materials being stacked on a stacking platform of a stacking workstation substantially level.

BACKGROUND OF THE INVENTION

Stackers for receiving sheet materials such as signatures or newspapers in a stream and for forming them into stacks are well known. Typical are the stackers shown in U.S. Pat. Nos. 4,139,191; 4,037,525; 3,851,773; 3,538,818; 3,479,932; 3,450,275; 3,480,503; and 2,672,079. These stackers receive a stream of publications, form them into stacks and deposit them on a conveyor for subsequent handling.

One particular type of stacker includes a platform that moves downward as the sheet materials are being stacked on the platform. Such a stacker is disclosed in a pending application of Mohanjit Singh Chandhoke and myself, Michael B. Duke, entitled "Apparatus for Forming a Stack of Signatures", U.S. Application No. 518,015, which is assigned to the assignee of this invention. Such a stacker may include a counter positioned upstream of the stacking workstation for counting the number of signatures being fed to a stack. Sensors may be utilized to determine stack dimensions. When a predetermined number of signatures needed to complete a stack is counted or a sufficient amount of signatures have been fed to complete a stack of predetermined dimension, a gapper apparatus, positioned upstream along the conveyor feed path, interrupts the flow of the sheet materials. A gap is thus formed in the stream of sheet materials. After a predetermined delay, the gapper apparatus releases the sheet materials and the stream continues. A slug of sheet materials will be present at the beginning of the next group of sheet materials to be stacked, the slug being caused by the gapper stopping the flow of sheet materials while the conveyor continued to drive the remainder of the sheet materials located upstream of the gapper. After a stack is completely formed at the stacking workstation, the stacking platform holding the completed stack descends downward to make room for a new succeeding stack and to move the completed stack to an intermediate platform. An interceptor is immediately positioned when a gap is sensed to accept sheet materials which will form the next stack. The formation of a gap is necessary to provide sufficient time for proper operation of the movable platform and operation of the interceptor. The completed stack is transferred from the platform to the intermediate platform where it is held until clamped and removed. Prior to clamping the stack, it is desirable to have the stack top as level as possible. After the previously formed stack is removed from the stacker, the platform ascends and meets the descending interceptor to take over the holding function of the new stack being formed. The interceptor is then retracted and is repositioned ready to accept the next stack to be formed after another gap is sensed.

An articulating upper belt assembly such as disclosed in a pending application of Harry Conrad Noll, Jr., entitled "Articulating Sheet Material Conveyor", U.S. Application No. 601,806, which is assigned to the assignee of this invention, can be used with mine and Mr. Chandhoke's stacker to sense the top of the sheet materials being stacked and to control the descent rate of the movable stacking platform. A device utilized to clamp and remove a completed stack of signatures from a stacker is disclosed in a pending application of Frank H. Convey, Jr., entitled "Signature Transfer Vehicle With Stack Clamping Mechanism", U.S. Application No. 518,014, now U.S. Pat. No. 4,498,381 and in a pending application of James C. Wise, entitled "Signature Handling Apparatus", U.S. Application No. 525,840, both assigned to the assignee of this invention. Signatures are typically folded when they are stacked.

A stack of signatures contains a certain amount of air as a result of folds in the signatures. Prior to clamping and removing a completed stack of signatures from the stacker, it is desirable that the stack be neatly formed with the top of the stack as level as possible by reducing the air content.

Some devices have been proposed to remove air from a stack of signatures. One such device is proposed in U.S. Pat. No. 3,617,055 to Stal. This patent proposes that the signatures be compressed by the feeding conveyors. Belts are provided to move through the stacking region at a rate faster than the movement of the buckets through the stacking region to further compress the forward folded edges of the signatures downward as each bundle is being formed.

Another device proposing to remove air from stacks of signatures is U.S. Pat. No. 4,296,684 to Wangerman. This patent proposes a stack presser to press the folded edges of the signatures downward.

These two proposed solutions apply a non-adjustable amount of force against one side of the stack. If the top of the stack is not being slanted because of fold-air build-up or is being slanted more than anticipated, the proposed devices continue to apply the same amount of downward force to the one side.

SUMMARY OF THE INVENTION

In accordance with this invention there is provided a new and improved method and apparatus for maintaining the top of sheet materials being formed into a stack at a stacking workstation substantially level. The new method and apparatus is designed to compare the vertical position of two spaced apart locations on the top of sheet materials being stacked on a stacking platform. Tangential, frictional driving force is applied to the side of the stack being formed, the amount of force being responsive to the vertical position of the two spaced apart locations.

A stack top control apparatus in accordance with the invention includes spaced apart vertical position sensing means operatively coupled to a top of sheet materials being stacked on a stacking platform. Comparing means is provided operatively coupled to the sensing means for comparing vertical position of the spaced apart locations. Frictional drive means is provided tangentially contacting a side of the sheet materials being stacked on the stacking platform for applying a drive force to the side toward the stacking platform. Control means is provided operatively coupled to the comparing means and the frictional drive means for varying the amount of drive force responsive to the compared vertical positions, the drive force reducing a difference in vertical positions.

A method for substantially leveling a top of a stack of sheet materials being stacked on a stacking platform in accordance with the present invention includes the step of sensing the vertical position of two spaced apart locations on the top of the stack being formed. Another step is comparing the vertical position of the two spaced apart locations. Another step is providing a frictional drive force tangentially engaging a side of sheet materials on the stacking platform. And another step is varying the amount of drive force responsive to the compared vertical positions of the two spaced apart locations, the drive force reducing a difference in vertical position between the two spaced apart locations.

In the disclosed and preferred embodiment, an apparatus for substantially leveling a top of sheet materials being formed into a stack on a stacking platform includes a first vertical position sensor operatively coupled to a first location on the top of the sheet materials on the stacking platform. A second vertical position sensor is operatively coupled to a second location on the top of the sheet materials on the stacking platform. The first location is spaced from the second location with the first location and the second location near different sides of the stack being formed. First drive means tangentially engages a first side of the sheet materials on the stacking platform near the first vertical position sensor for applying a variable amount of frictional drive force to the first side. Second drive means tangentially engages a second side of the sheet materials on the stacking platform near the second vertical position sensor for applying a variable amount of frictional drive force to the second side. Control means is operatively coupled to the first and the second vertical position sensors and to the first and the second drive means for comparing the sensed vertical position of the first location with the sensed vertical position of the second location and for controlling the first and the second drive means to vary the amount of drive force applied to the first and the second sides of the sheet materials on the stacking platform to reduce a difference in vertical positions between the first and the second locations.

Another feature of the invention is that the first side and the second side of the sheet materials on the stacking platform respectively engaged by the first and the second drive means are opposed sides. The first and the second locations on the top of the stack of sheet materials being stacked are respectively near the first and the second sides of the sheet materials on the stacking platform.

Another feature of the invention is the provision that the first and the second drive means each include a continuous belt assembly. A side of each belt assembly tangentially engages at least a portion of an associated side of the sheet materials on the stacking platform. Each belt assembly frictionally drives its associated side of the sheet materials on the stacking platform toward the stacking platform.

Yet another feature of the invention is the provision that the first and the second vertical position sensors each include an angle bar respectively contacting the first and the second location on the top of the stack being formed and a linear voltage differential transformer operatively connected to the angle bar. Each linear voltage differential transformer produces an electrical signal indicative of the vertical position of its associated location on the top of the stack being formed.

Still yet another feature of the invention is the provision that the first and the second drive means each further include a drive motor for driving the continuous belt assembly and that the control means is operatively coupled to each drive motor of each belt assembly. Speed of each motor is controlled by the control means responsive to sensed vertical position of the first and the second location.

Other features and advantages and a fuller understanding of the invention will be had from the following detailed description and the accompanying drawings.

DESCRIPTION OF THE PREFERRED EMBODIMENT

Figure 1:
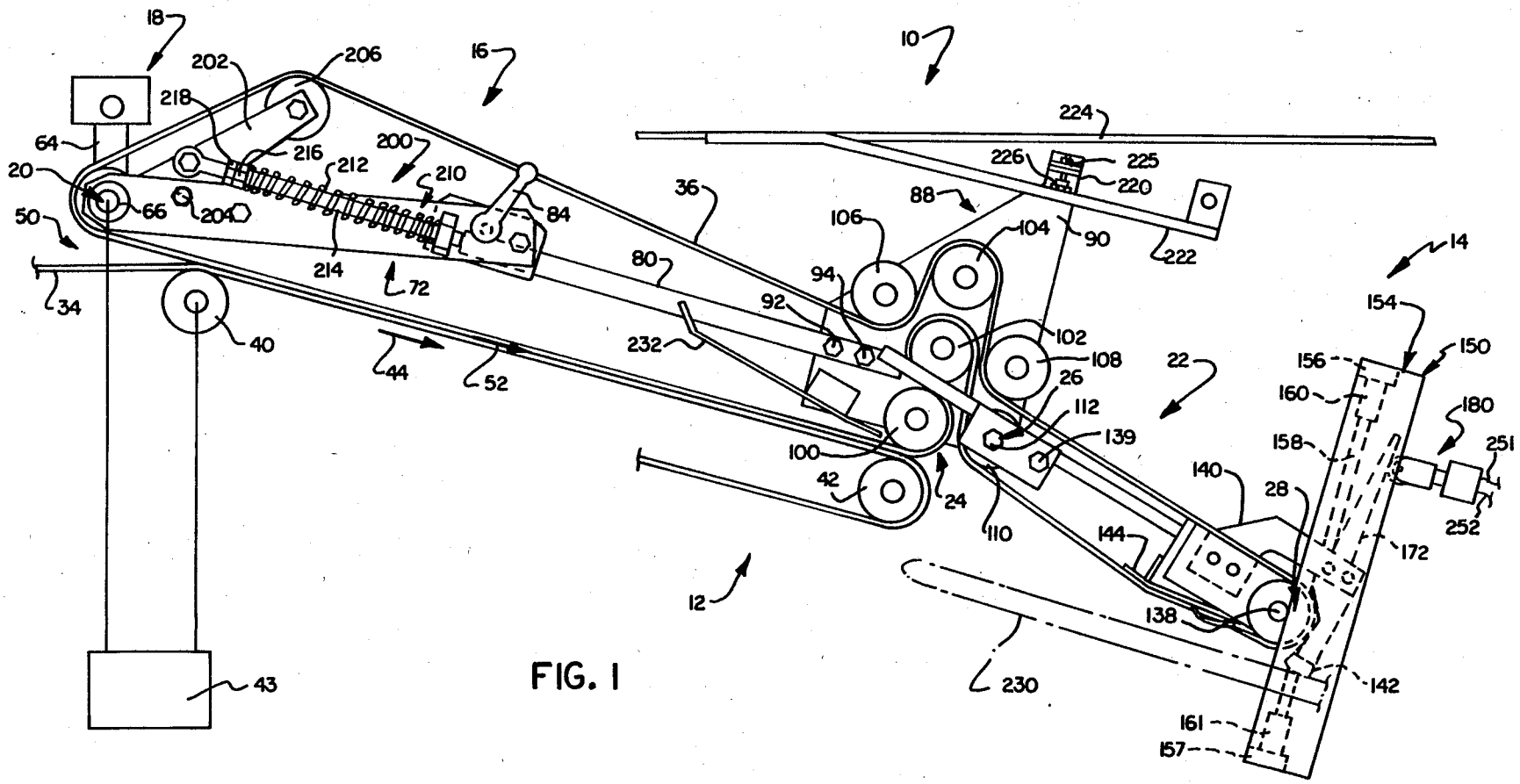
FIG. 1 is a side elevational view partially in fragmentary form showing a conveyor assembly with some parts removed for clarity.

A description of the invention follows, referring to the drawings in which like reference numerals denote like elements of structure in each of the several figures.

Figure 2:
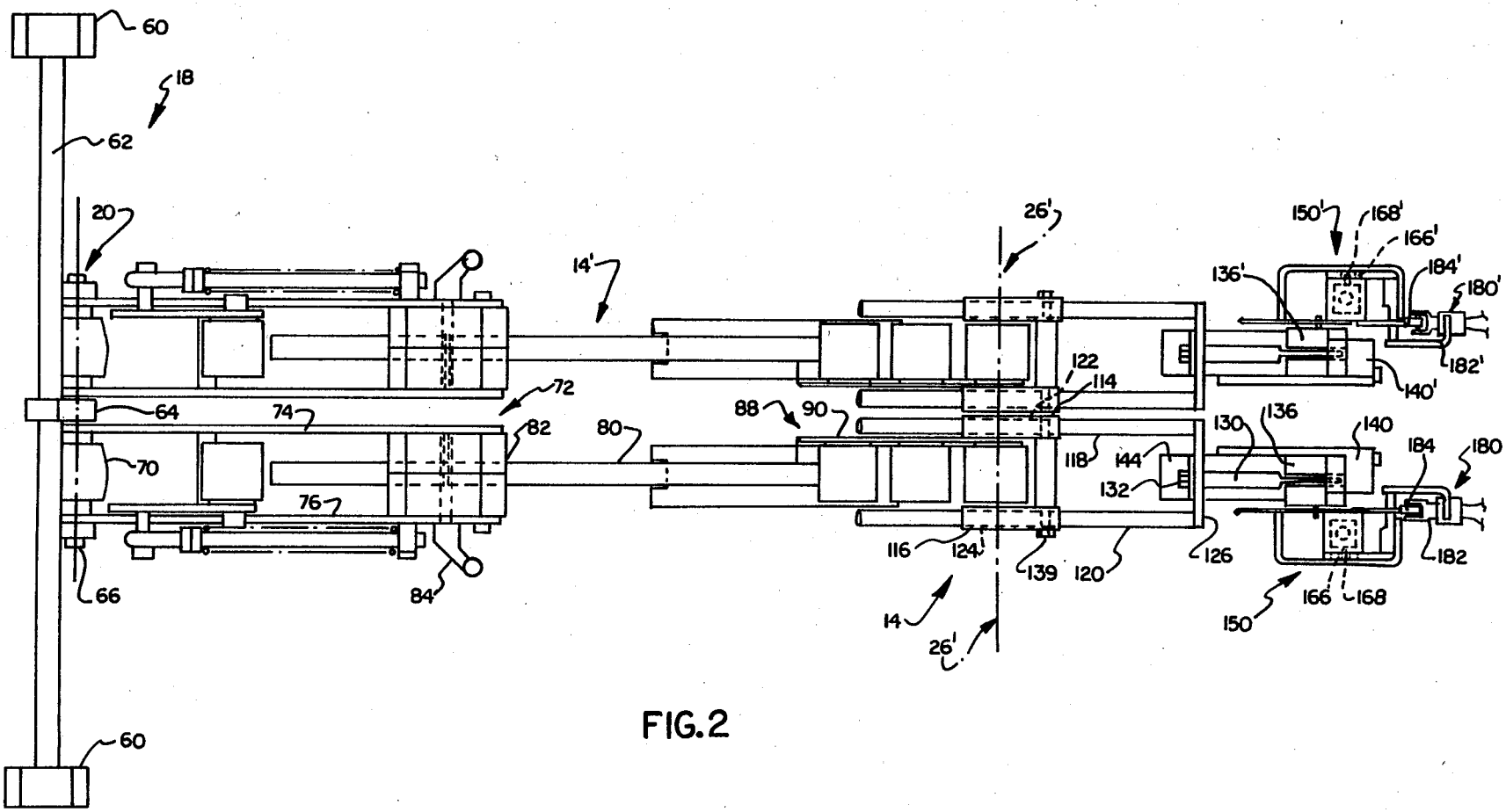
FIG. 2 is a top plan view of a upper conveyor portion of he conveyor assembly of FIG. 1 with some parts removed for clarity.

Referring now to FIGS. 1 and 2, a conveyor assembly 10 is preferably provided in accordance with pending U.S. patent application of Harry Conrad Noll, Jr., U.S. Ser. No. 601,806 whose disclosure is fully incorporated herein by reference. Such conveyor assembly 10 includes two lower conveyor portions 12 and two upper conveyor portions 14, 14'. Each of the two upper and lower conveyor portions are positioned side by side and are mirror image constructions of the respective other upper and lower conveyor portions. Therefore, whenever one upper conveyor portion and its associated lower conveyor portion is described, it is to be understood that the mirror image other upper and lower conveyor portions are constructed and work in a similar manner. Unprimed and primed numbers are used to denote like elements of structure in the corresponding mirror image upper and lower conveyors.

The lower conveyor 12 is disposed between a source location and a stacking workstation. The upper conveyor portion 14 has a first conveyor section 16 pivotably connected to a stationary frame 18 at an upstream pivot axis 20. The first conveyor section 16 is position above a downstream end section of the lower conveyor portion 12.

The upper conveyor portion 14 also includes a second conveyor section 22 pivotally connected adjacent a downstream end 24 of the first conveyor section 16 at an upstream pivot axis 26 of second conveyor section 22. A downstream end 28 of the second conveyor section 22 is adapted to be operatively coupled to the top of a stack of signatures being formed at a stacking workstation, this being described in further detail below.

Lower conveyor portion 12 includes a conveyor belt 34. Upper conveyor portion 14 includes a continuous conveyor belt 36 common to both the first conveyor section 16 and the second conveyor section 22. The first conveyor section 16 and the lower conveyor 12 sandwich sheet materials between belts 34, 36, this area defining a sandwich portion. Each upper conveyor portion 14, 14' articulates independent of the other in response to the profile of a stream of signatures sandwiched between belts 34, 36 in a manner fully described in Mr. Noll's patent application referred to above.

The lower conveyor portion 12 includes an infeed roller 40 and a downstream end roller 42. The conveyor belt 34 is driven from a drive motor 43 in the direction of arrow 44. Signatures are carried on the belt 34 from a source location to a sandwich infeed location 50 formed by the lower conveyor 12 and the first conveyor section 16. Those skilled in the art will appreciate the need to sandwich signatures prior to the stacking workstation. The feed path 52 just prior to the stcking workstation is inclined downward with respect to horizontal to aid in the stacking process. If the signatures were not sandwiched at the inclined feed path, they would tend to slide under the force of gravity.

It is desirable to have the downstream end roller 42 of the bottom conveyor portion 12 near an upstream end of a stacking platform of a stacking workstation where the signatures are being stacked. Since signatures vary in size, the distance between an upstream end of a stacking platform and a backstop of a stacker is adjustable. The position of the downstream end roller 42 is longitudinally adjustable to position it adjacent to the upstream end of a stacking platform.

Stationary frame 18 has spaced apart mounting members 60 holding a fixed cross member 62. Connecting arm 64 extends centrally from the cross member 62. Shaft 66 is connected to the connecting arm 64, shaft 66 defining the pivot axis 20.

First conveyor section 16 includes an upstream end roller 70 rotatably mounted on the shaft 66. The frame 18 maintains roller 70 spaced a predetermined distance above the belt 34 to form the signature receiving opening 50. First conveyor section 16 further includes a longitudinal part 72 having spaced apart members 74, 76 both pivotably connected to shaft 66 and extending longitudinally downstream from the upstream pivot axis 20.

A connecting shaft 80 is received in a split bore receiving portion 82 of the longitudinal part 72. A threaded handle 84 spans the slit of the split bore receiving portion 82 in a known manner. Rotation of handle 84 urges the split bore closed and thus frictionally retains an upstream portion of the connecting shaft 80 to the longitudinal part 72.

A transfer section 88 includes a roller holding plate 90 fixed to the downstream end of the connecting shaft 80 by means of bolts 92, 94.

First conveyor section 16 includes a downstream end roller 100 rotatably mounted to the roller holding plate 90. Transfer rollers 102, 104 are rotatably mounted to roller holding plate 90 and are in line with downstream end roller 100 of the first conveyor section 16. The connecting shaft 80 is longitudinally adjusted with respect to the first longitudinal part 72 by means of the split bore 82 to have the end roller 100 in line with the downstream end roller 42 of the lower conveyor portion 12. Transfer rollers 106, 108 are rotatably mounted to the roller holding plate 90. Transfer roller 106 is positioned upstream from and approximately half way between transfer rollers 102, 104. Transfer roller 108 is positioned downstream of and approximately in line with transfer roller 102.

Second conveyor section 22 includes an upstream end roller 110 rotatably mounted to roller holding plate 90 on a shaft 112 defining pivot axis 26. Shaft 112 extends through roller holding plate 90 and upstream end roller 110. Spaced apart split bore mounting members 114, 116 are pivotably mounted to opposed ends of shaft 112. Second conveyor section 22 includes spaced apart longitudinal mounting members 118, 120 respectively adapted to be received and held in bores 122, 124 of the mounting members 114, 116. Connecting plate 126 connects the downstream ends of longitudinal mounting members 118, 120 in fixed spaced apart relationship to each other. It will be appreciated that the members 118, 120 are pivotably connected to the roller holding plate 90 about pivot axis 26 by shaft 112. The upstream end of the second conveyor section 22 is thus pivotably mounted adjacent the downstream end 24 of the first conveyor section 16.

Second conveyor section 22 includes longitudinal arm 130 fixed to the plate 126 connecting the members 118, 120 by means of bolt 132. A downstream end roller 136 is rotatably mounted to a downstream end of longitudinal arm 130 by means of shaft 138. It will be appreciated that the longitudinal distance between the downstream end roller 136 and the upstream end roller 110 is adjustable by means of the split bore arrangement of split bore mounting members 114, 116 and tightening nut 139. The tightening nut 139 is threaded on a bolt, not shown, that spans the split bores 122, 124 in a known manner.

An interceptor deflector 140 is connected to the mounting member 130 of the second conveyor section 22 and includes an end piece adapted to contact an interceptor positioned from a stacking workstation to insure a distance between the interceptor and the belt 36 of the upper conveyor portion.

A belt guide 144 is fixed to plate 126 and is positioned upstream of end roller 136 and is adapted to bend belt 36 to lie in a plane approximately equal to the plane of the stacking platform.

A vertical position sensing assembly 150, also referred to as the angle bar assembly, is operatively coupled to the downstream end 28 of the upper conveyor portion 14. Referring now to all the figures, the vertical position sensing assembly 150 includes a fixed bracket assembly 154 having transverse extension arms 156, 157. Shaft 158 having stops 160, 161 spans the transverse extension arms 156, 157. A sliding cylinder 162 is mounted on the shaft 158 and can slide on the shaft between the stops 160, 161. Guide bars 166 having a slot 168 are fixed to the fixed bracket 154, FIG. 2. A guide pin 170 is fixed to and extends from the cylinder 162 and is received in the slot 168 to prevent the cylinder from rotating about the shaft 158. An angle bar 172 is pivotably fixed to a "C" shaped shaft receiving part 174. The receiving part 174 is fixed to the cylinder 162. The primed numbers in the figures represent corresponding elements of structure of the upper conveyor portion 14'.

Figure 3:
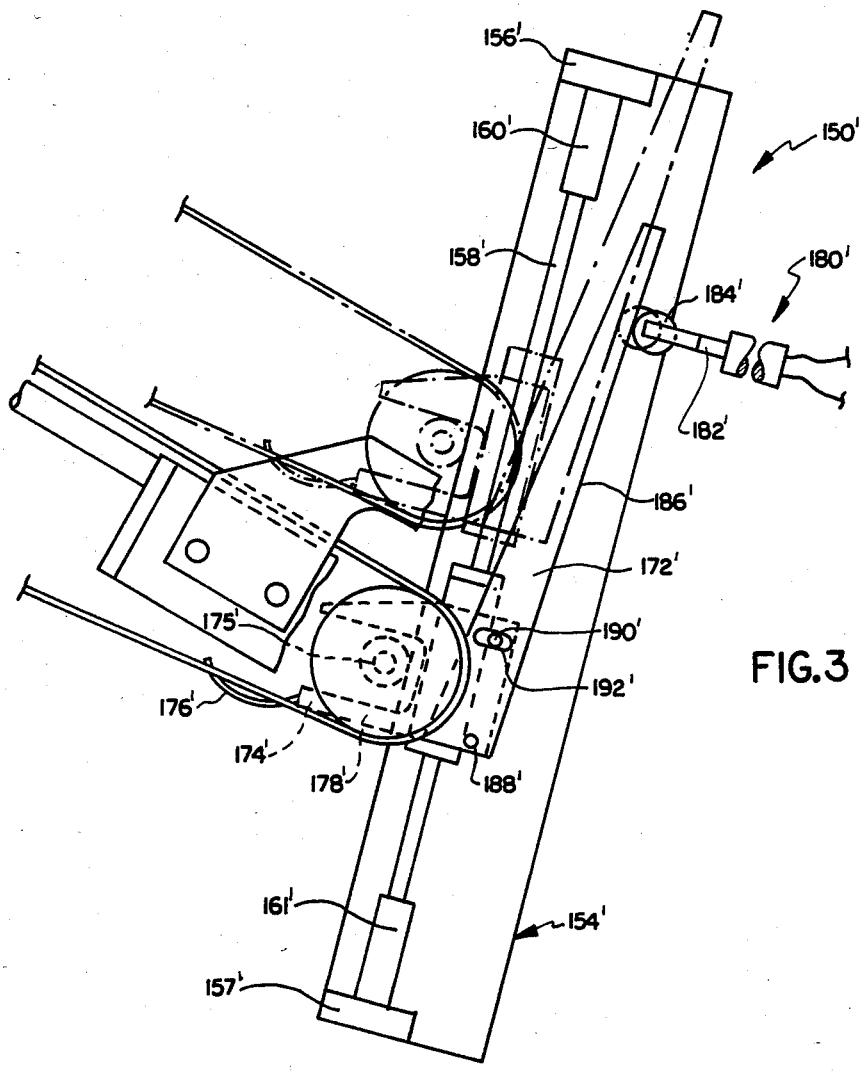
FIG. 3 is a side elevation view of a portion of the conveyor assembly on an enlarged scale, schematically illustrating the operation of an angle bar assembly.

Referring now to FIG. 3, the vertical position assembly will be better understood. FIG. 3 shows the vertical position assembly 150' for the upper conveyor portion 14'. Shaft 138' of the downstream end roller 136' has an extending arm portion 175' which is received in the shaft receiving part 174'. The "C" shaped opening of the shaft receiving part 174' is larger than the diameter of the shaft extending arm 175'. A rider skid 176' is operatively connected to a finger 178' of the shaft receiving part 174' by means of a bolt clamp, not shown. The rider skid 176' is parabolic in shape and is adapted to contact the top of the sheet materials being stacked. It will be appreciated that this arrangement operatively couples the downstream end of the second conveyor section 14' with one location on the top of stack of signatures being stacked at the workstation. When the vertical position of this location on the top of the stack changes, the rider skid 176' will be vertically displaced responsive to the change in vertical position. As the rider skid 176' vertically moves, the angle bar 172' will vertically move. Those skilled in the art will further appreciate that the lose fit between the shaft 138' and the receiving part 174' provides an amount of hysteresis between the motion of the angle bar 17' and the downstream end of the upper convey portion 14'. Also, it is desirable to have the downstream end roller 136' as near to the back stop of the stacker as possible. Therefore, when the longitudinal position of the downstream end roller of the first conveyor section is adjusted to be in line with the downstream end roller of the lower conveyor, the downstream end roller 136' is adjusted to remain near the back stop of the stacker. The lose fit between shaft 138' and the receiving part 174' permits this longitudinal adjustment. It will be appreciated that the second conveyor section maintains a drive engagement with the signatures as they are stacked.

A linear voltage differential transformer 180' is fixed to the bracket assembly 154' and includes a sensing arm 182' with a roller 184' fixed to the end of the arm 182'. The linear voltage differential transformer 180' is position so that roller 184' rides against surface 186' of the angle bar 172'. As the angle bar is vertically displaced, the surface 186' is correspondingly displaced longitudinally. It will be appreciated that the angle bar converts vertical motion into longitudinal motion. The arm 182', which is spring biased to retain the roller 184' in contact with the surface 186', reciprocates in response to the longitudinal motion of the angle bar 172'. It will be appreciated that the linear voltage differential transformer is sensing vertical position of the rider skid 176' and thus the top of the stack of sheet materials being stacked at the location of contact of rider skid 176'. Angle bar 172' is fixed to the receiving part 174' at one end by means of a bolt 188' and a bolt 190' received through a slot 192' on the angle bar 172' at a location spaced from bolt 188'. This attachment arrangement permits an initial angular adjustment of the angle bar 172' with respect to the fixed bracket assembly 154'.

Referring again to FIG. 1, a tensioning assembly 200 is connected to the to the first longitudinal part 72 of the first conveyor section 16. A tensioning arm 202 is mounted to longitudinal part 72 by pivot pin 204. A roller 206 is rotatably mounted to the other end of arm 202. A spring bias telescoping rod assembly 210 is connected to the tensioning arm 202 and to longitudinal part 72. A spring 212 surrounds a rod 214 and applies a bias force against the tensioning arm 202. The amount of biasing force is adjustable by means of adjustment nuts 216, 218.

A lower conveyor belt 34 contacts roller 40 and goes around roller 42. The lower conveyor belt 34 is an endless belt and is driven by a drive motor 43 in the direction of arrow 44.

A upper conveyor belt 36 is an endless belt. Starting with roller 70, the belt contacts roller 100 and is rapped in a counter clockwise direction around a portion of roller 100. The belt is then rapped around roller 102 clockwise, counter clockwise around roller 110, to belt guide 144, counter clockwise around roller 136, clockwise around a portion of roller 108, counter clockwise around roller 104, clockwise around roller 106, counter clockwise around roller 206 and returns counter clockwise around roller 70. Belt guide 144 flattens the belt upstream of end roller 136 to have the belt in the same plane as the signatures being stacked. The spring bias assembly 200 maintains the belt 36 in an adjustable amount of tension by adjusting the spring bias force against arm 202. Belt 36 also moves in the direction of arrow 44. The transfer section 88 maintains the belt 36 in contact with the upstream and downstream rollers of each the first conveyor section 16 and the second conveyor section 22. The belt 36 and belt 34 are both driven from a common source so that they have matched movement. One of the rollers in the upper conveyor 14 can be driven from the drive motor 43 driving the lower convey by utilizing flexible shafts. It has been found that driving roller 70 of the upper conveyor eliminates the need for flexible shafts since roller 70 is fixed in space both vertically and horizontally.

Transfer section 88 includes a "L" shaped adjustment bracket 220 fixed to the roller holding plate 90. The bracket 220 extends over a fixed member 222 which is fixed to and angled with respect to a horizontal fixed member 224 approximately equal to the incline of the feed path 52. A bolt 225 is threaded though the bracket 220 and contacts an upper surface 226 of member 222. It will be appreciated that the first conveyor section is pivotable at one end about a pivotal axis 20. Bolt 225 is used to adjust the spatial relationship between roller 100 and roller 42. It is preferable that there be a small gap between the belts at the position of rollers 100, 42 to ease frictional forces between the upper and lower conveyor belts. The bolt 225 thus acts as a stop to limit the pivotal motion of the first conveyor section 16.

The second conveyor section pivots about an axis 26 in response to pivotal motion of the first conveyor section 16 or in response to the position of rider skid 176 as it rides on the signatures being stacked on the stacker. FIG. 1 shows an interceptor 230 in a ready position with no signatures on it.

A belt deflector guide 232 is fixed to the roller holding plate 90 and is angled upstream away from the feed path 52. The belt deflector guide limits the amount that the belt 36 can deflect in the sandwich portion.

The operation of the conveyor assembly 10 is fully discussed in Mr. Noll's Patent Application referred to above. The two lower conveyors 12 lie in the same plane with respect to each other and are fixed in that plane. The two upper conveyors 14, 14' can pivot about axis 20 independent of each other and can articulate respectively about axis 26, 26' independent of each other.

Figure 4:
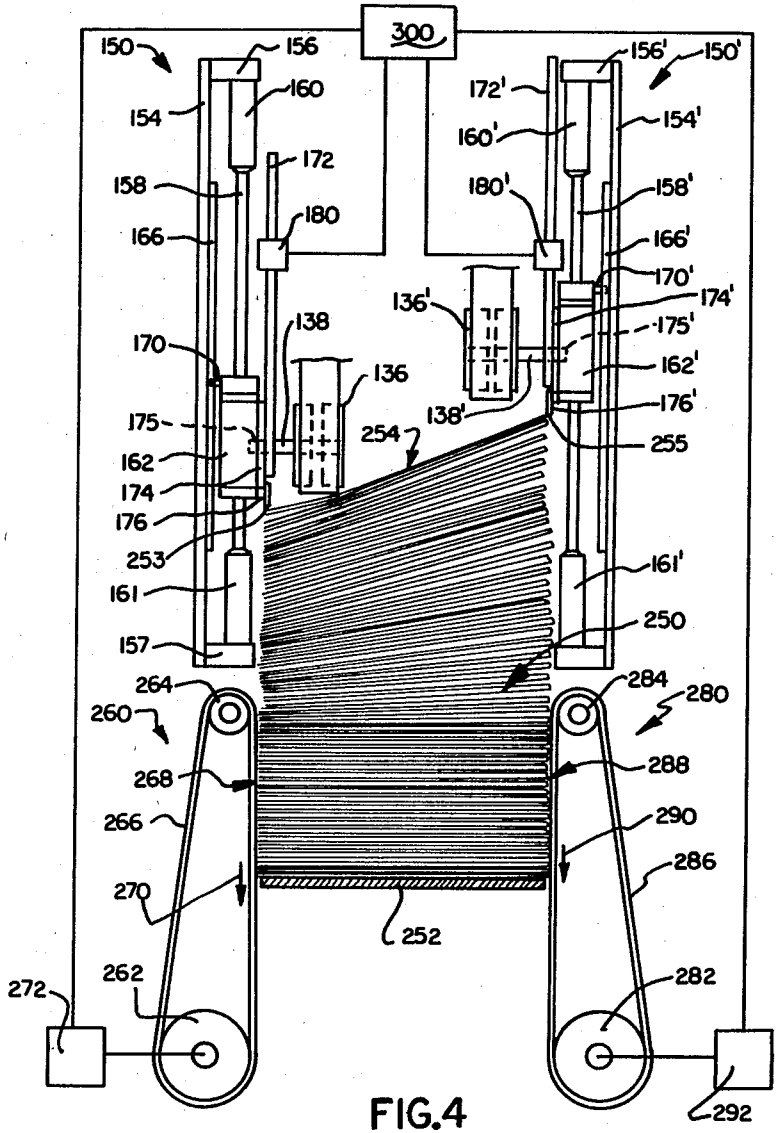
FIG. 4 is a side elevation view schematically showing a stack top control apparatus in accordance with the present invention with the slant of the top of the signatures being exaggerated for illustrative purposes.
Figure 5:
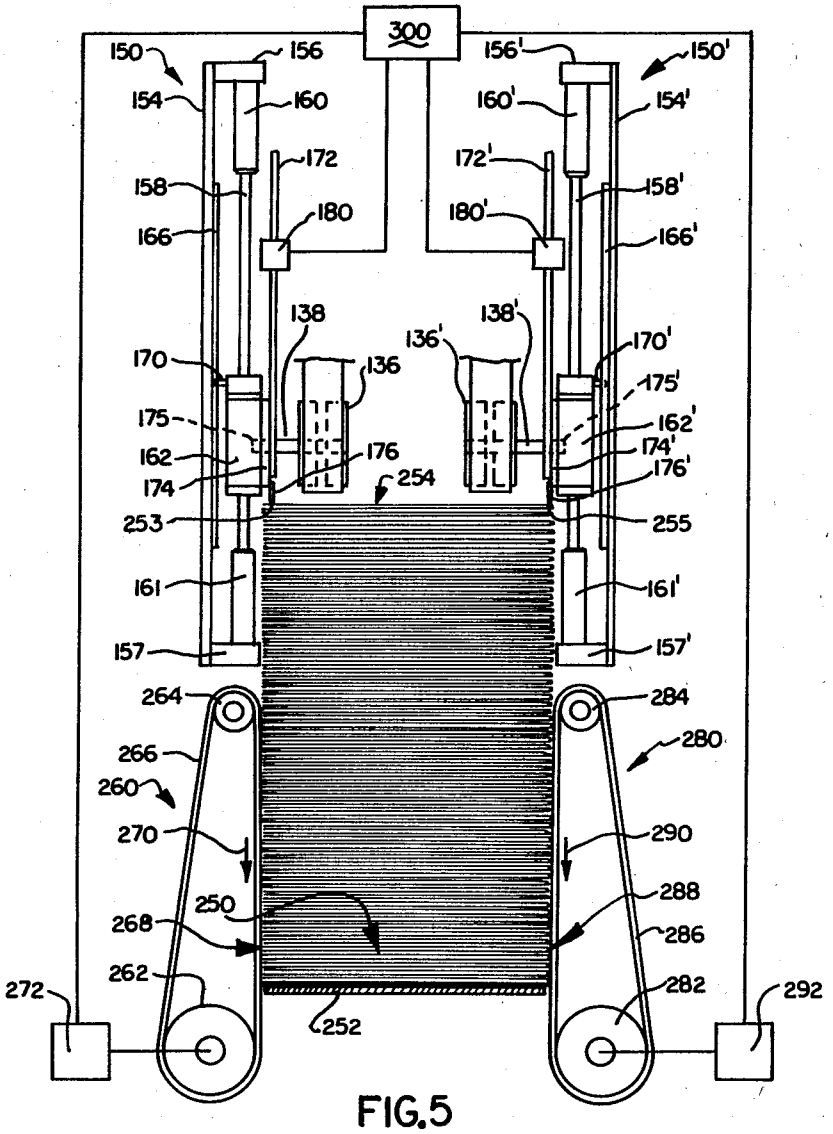
FIG. 5 is a side elevation view schematically showing the present invention with the top of the stack of signatures being maintained substantially level.

Referring now to FIGS. 4 and 5 a plurality of signatures 250 are being stacked on a movable platform 252. Rider skid 176 of upper conveyor portion 14 contacts one location 253 on the top 254 of the signatures 250 being stacked on the platform 252. Rider skid 176' of upper conveyor portion 14' contacts a second location 255 on the top 254 of the stack of the signatures 250. Signatures conveyed from a source location to a stacking workstation are typically folded. As the signatures are stacked, the top of the stack will typically slant because of the fold. This is also referred to as air in the signatures. FIG. 4 schematically depicts the circumstance in which the location 255 is vertically higher than location 253 because of a fold in the signatures 250 near the location 255.

A first belt assembly 260 having belt rollers 262, 264 is positioned below the top 254 of the stack of signatures 250. Belt 266 is entrained around rollers 262, 264. The belt assembly 260 is disposed adjacent the descent path of stacking platform 252 and positioned to tangentially contact the side 268 of the stack 250. Belt 266 of belt assembly 260 is driven in the direction of arrow 270 by means of a variably controlled drive motor 272. Belt assembly 260 applies a tangential, frictional drive force to the side 268 of the stack 250 toward the stacking platform 252.

A second belt assembly 280 having rollers 282, 284 is positioned below the top 254 of the stack of signatures 250. Belt 286 is entrained around rollers 282, 284. The belt assembly 280 is disposed adjacent the descent path of the stacking platform 252 and position to tangentially contact the side 288 of the stack 250 which is opposite side 268. Belt 286 of belt assembly 280 is driven in the direction of arrow 290 by means of a variable controlled drive motor 292. Belt assembly 280 applies a tangential, frictional drive force to the side 288 of the stack 250 toward the stacking platform 252.

A control circuit 300 is operatively connected to drive motor 272, to drive motor 292, to linear voltage differential transformer 180 and to linear voltage differential transformer 180'. Each of the linear voltage differential transformers 180, 180' produce an electrical signal indicative of the vertical position of rider skids 176, 176' respectively. Control circuit 300 compares the two vertical positions and controls the two drive motors 272, 292 responsive to the sensed vertical positions. It is preferable that the drive motors continuously drive the belts 266, 286 in the direction of arrows 270, 290 respectively and that the control circuit 300 control the speed of the motors.

Referring to FIG. 5, a condition is depicted in which the control circuit is controlling the motors 272, 292 to substantially level the top 254 of the stack of signatures 250 on the stacking platform 252. In this condition, the belt 286 will be driven at a faster speed than belt 266 because the fold is closer to the rider skid 276'. The increased speed of the belt 286 increases the amount of drive force to side 280 of the stack 250 thus driving the side 280 downward and substantially leveling the top 254 of the stack.

This invention has been described with reference to preferred embodiments. Modifications and alterations may occur to others upon reading and understanding this specification. It is my intention to include all such modifications and alterations insofar as they come within the scope of the appended claims or the equivalent thereof.

We claim:

1. A stack top control apparatus comprising:

spaced apart vertical position sensing means for sensing respective vertical positions of spaced locations of a top of a stack of sheet materials on a stacking platform;

comparing means operatively coupled to said sensing means for comparing the vertical positions of said spaced apart locations;

frictional drive means tangentially contacting a side of said stack of sheet materials on said stacking platform for applying a drive force to said side toward said stacking platform; and control means operatively coupled to said comparing means and said frictional drive means for varying the amount of said drive force in response to said compared vertical positions to reduce the difference in the vertical positions.

2. A stack top control apparatus comprising:

a support for supporting sheet materials being formed into a stack;

first sensing means for sensing the vertical position of a first location of the top of said stack;

second sensing means for sensing the vertical position of a second location of the top of said stack, said second location being spaced from said first location;

comparing means operatively coupled to said first sensing means and said second sensing means for comparing the vertical positions of said first location and said second location; and drive means operatively coupled to said comparing means and tangentially engaging a side of said stack on said support for applying a frictional driving force to said side of said stack, the amount of driving force being responsive to said comparing means, said drive means reducing a difference between the vertical position of said first location and said second location.

3. An apparatus for substantially leveling a top of sheet materials being formed into a stack on a stacking platform, said apparatus comprising:

a first vertical position sensor operatively coupled to a first location on the top of the stack being formed on said stacking platform;

a second vertical position sensor operatively coupled to a second location on the top of said stack being formed on said stacking platform, said first location spaced from said second location, each said first location and said second location near different sides of said stack being formed;

first drive means tangentially engaging a first side of said stack being formed on said stacking platform near said first vertical position sensor for applying a variable amont of frictional drive force to said first side;

second drive means tangentially engaging a second side of said stack being formed on said stacking platform near said second vertical position sensor for applying a variable amount of frictional drive force to said second side; and control means operatively coupled to said first and said second vertical position sensors and to said first and said second drive means for comparing the sensed vertical position of said first location with the sensed vertical position of said second location and for controlling said first and said second drive means to vary the amount of drive force applied to said first and said second sides of said stack being formed on said stacking platform to reduce a difference in vertical position between said first and said second locations.

4. The apparatus of claim 3 wherein said first side and said second side of said stack being formed on said stacking platform respectively engaged by said first and said second drive means are opposed sides, said first and said second locations being respectively near said first and said second sides.

5. The apparatus of claim 4 wherein said first and said second drive means each include a continuous belt assembly, a side of each assembly tangentially engaging at least a portion of an associated side of said stack being formed on said stacking platform, each said belt assembly frictionally driving its associated side of said stack being formed on said stacking platform toward said stacking platform.

6. The apparatus of claim 5 wherein said first and said second vertical position sensors each include an angle bar respectively coupled to said first and said second location on the top of said stack being formed and each include a linear voltage differential transformer operatively connected to said angle bar, each linear voltage differential transformer producing an electrical signal indicative of the vertical position of its associated location on the top of said stack being formed.

7. The apparatus of claim 5 wherein said first and said second drive means each further include a drive motor for driving said continuous belt assembly and wherein said control means is operatively coupled to each drive motor of each belt assembly, speed of each said motor being controlled by said control means responsive to sensed vertical position of said first and said second location.

8. An apparatus for substantially leveling a top of sheet materials being formed into a stack on a platform, said apparatus comprising:

a first vertical position sensor operatively contacting a first location on the top of the stack being formed on said platform near a first side of said stack being formed on said platform, said first vertical position sensor producing an electrical signal indicative of vertical position of said first location;

a second vertical position sensor operatively contacting a second location on the top of said stack being formed on said platform, said second location spaced from and near a second side of said stack being formed on said platform opposite said first side, said second vertical position sensor producing an electrical signal indicative of vertical position of said second location;

first belt assembly tangentially contacting at least a portion of said first side of said stack being formed on said platform near said first location, said first belt assembly applying a variable amount of frictional drive force to said first side toward said platform;

second belt assembly tangentially contacting at least a portion of said second side of said stack being formed on said platform near said second location, said second belt assembly applying a variable amount of frictional drive force to said second side toward said platform;

first drive motor operatively coupled to said first belt assembly for driving a belt thereon;

second drive motor operatively coupled to said second belt assembly for diving a belt thereon; and a control circuit operatively coupled to said first and said second vertical position sensor and to said first and said second drive motors, said control circuit monitoring the electrical signals indicative of vertical position of said first and said second location and controlling the speed of said first and said second drive motors responsive to the monitored signals to at least reduce any difference in vertical position between said first and said second locations.

9. A method for substantially leveling a top of a stack of sheet materials on a stacking platform, said method comprising the steps of:

(a) sensing the vertical position of two spaced apart locations on a top of said stack;

(b) comparing the vertical position of said two spaced apart locations;

(c) providing a frictional drive force tangentially engaging a side of said stack on said stacking platform; and (d) varying the amount of drive force responsive to said compared vertical positions of said two spaced apart locations, said drive force reducing a difference in vertical position between said two spaced apart locations.

10. A method for substantially leveling a top of a stack of sheet materials being stacked on a stacking platform, said method comprising the steps of;

(a) sensing the vertical position of a first and a second location on the top of said stack of sheet materials being stacked on said stacking platform, said first and said second locations spaced apart and near opposed sides of said stack of sheet materials on said stacking platform;

(b) comparing vertical position of said first and said second locations;

(c) providing frictional drive force tangentially engaging at least a portion of each said opposed side of said stack of sheet materials on said stacking platform near said first and said second locations; and (d) varying the amount of drive force against each opposed side of said stack of sheet materials on said stacking platform responsive to said compared vertical position of said first and said second locations, said varying amount of drive force substantially leveling the top of the stack of said sheet materials being stacked on said stacking platform.

* * * * *